US005975939A

United States Patent [19]

Market

[11] Patent Number: 5,975,939

[45] Date of Patent: Nov. 2, 1999

[54] TWIST TERMINATION CONNECTOR

[75] Inventor: Roger A. Market, Eau Claire, Wis.

[73] Assignee: Ideal Industries, Inc., Sycamore, Ill.

[21] Appl. No.: 08/954,574

[22] Filed: Oct. 20, 1997

[51] Int. Cl.[6] ..... H01R 4/24

[52] U.S. Cl. ..... 439/415; 439/433; 439/434; 174/87

[58] Field of Search ..... 439/411, 415, 439/431, 433, 434, 840, 841, 412, 416, 427–430, 432, 786, 788, 790–794, 882; 174/87, 74 R, 84 R, DIG. 8, 94 R, 91

[56] References Cited

U.S. PATENT DOCUMENTS

| | | | |
|---|---|---|---|
| 2,792,560 | 5/1957 | Bollmeier | 439/245 |
| 3,517,112 | 6/1970 | Wahl | 439/427 |
| 5,418,331 | 5/1995 | Delalle | 439/882 |
| 5,514,836 | 5/1996 | Delalle et al. | 174/87 |
| 5,531,618 | 7/1996 | Market | 439/840 |

*Primary Examiner*—Steven L. Stephan
*Assistant Examiner*—Hae Moon Hyeon
*Attorney, Agent, or Firm*—Dorn, McEachran, Jambor & Keating

[57] ABSTRACT

A connector terminal which twist mounts to one or more electrical conductors. A terminal fitting includes a number of prongs and a terminal end. The terminal end is selected to accommodate a particular one of a variety of terminations. The prongs are staked within an insulated housing and are conically flared outward to fit mating recesses at the housing. A spiral wound spring having a compound tapered longitudinal surface is screw fitted to the staked prongs and housing. Edges of the spring windings bite into the prongs and housing to permanently secure the termination end and spring to the housing. Connectors having alternative terminal ends are disclosed for making a wide variety of electrical connections.

21 Claims, 8 Drawing Sheets

TWIST TERMINATION CONNECTOR

BACKGROUND OF THE INVENTION

The present invention relates to electrical terminations and, in particular, to a "twist-on" type of connector terminal which non-permanently mounts to one or more conductors for electrically joining the conductors and making an electrical connection to a variety of termination points without undue time and conductor preparation.

Electrical terminations can be created in various fashions. A rudimentary connection can be achieved by merely touching or securing an exposed end of a conductor to an appropriate connection, such as by fastening an exposed conductor beneath a screw or inserting the conductor end into a mating fastener. Frequently, multiple conductors are spliced together, for example, by twisting or soldering exposed ends together before covering the joint with tape, shrink tubing or another electrically insulating cover.

A "twist-on" connection is commonly used to electrically join or splice multiple conductors within an insulated housing. Depending upon the type of twist-on wire, the conductors can be secured to the housing with screw fasteners or can be directly screwed to the housing to compress the conductor ends together. Many twist-on wire connectors contain a spiral wound spring that expands to secure the conductors together under compression. A variety of twist-on wire connectors of differing constructions are commercially available, but all of which merely connect a number of twisted wires together without accommodating a further connection to a terminal. Such other terminal may also require a custom terminal end.

The latter type of connection is frequently required when it is necessary to connect multiple conductors to a single, common termination point, such as when making control circuit connections. One solution is to connect the individual conductors to a terminal strip and from which a conductor having an appropriate termination end can be routed to the termination point. Multiple conductors can also be spliced together with a custom prepared pigtail having an appropriate terminal end. An oversized connector terminal having an appropriate terminal end may also be secured to a number of conductors. Such connector terminals frequently require the conductors to be secured with solder or included crimp or screw fasteners. In all cases, an appreciable amount of time is required to prepare a custom termination from a number of parts that are specially adapted to the particular wiring problem.

A connector terminal which addresses the foregoing problem is disclosed in U.S. Pat. No. 5,531,618 and wherein a twist-on type of terminal connector is disclosed. A conical, spiral wound spring is provided at the connector to permit a twist mounting to one or more conductors. The connector terminals include a variety of termination ends, which are permanently secured to an internal spring. Electrical continuity between the spring and terminal end is obtained, for example, by brazing or soldering the terminal end directly to the spring. Terminal ends extending from integral springs are also suggested. Either alternative provides suitable electrical continuity, although the alternative used can affect the cost of the finished connector terminal.

The present invention provides connector terminals wherein a discrete terminal fitting and spring provide an improved fastening between the spring and termination end. A durable connection is made, which assures electrical continuity and which can be readily effected in a high volume manufacturing setting.

A variety of types of terminal ends are particularly disclosed wherein various terminal ends include a collar and from which a number of prongs extend. The prongs are fitted to grooves at a housing molded from an appropriate electrical insulator and flared or staked to the housing. A tapered spring, in turn, is fitted to the housing to create a permanent, non-removable connection between the terminal end, spring and housing.

SUMMARY OF THE INVENTION

It is a primary object of the invention to provide a "twist-on" type of electrical connector terminal which readily attaches to one or more conductors and facilitates a further attachment to a variety of termination points.

It is a further object of the invention to provide a connector terminal having a terminal end containing a number of prongs which are staked to an insulated housing.

It is a further object of the invention to provide a connector terminal wherein a number of prongs are separately secured to the housing with a conical spring mounted within the housing.

It is a further object of the invention to provide a conical spring formed from a conductive wire material having a rectilinear cross section and a longitudinal tapered surface that exhibits a number of different angular orientations relative to a center longitudinal axis.

Various of the foregoing objects, advantages and distinctions of the invention are obtained in a number of presently preferred connector terminals which include a terminal fitting having a number of prongs which are conically flared outward as they are staked to mating grooves at an insulated housing. A spiral wound spring, wound from a material having a rectilinear cross section and wound to provide a longitudinal compound tapered surface, is mounted to secure the prongs and spring to the housing.

A variety of terminal ends are provided at the connector terminals, including pigtail type, spade or fork type, and crimp type terminal ends. Numerous other conventional terminal ends can be similarly adapted with prongs to provide still other twist-on connector terminals; for example, such terminal ends can accommodate male or female connections and exhibit flat, rolled, or pin type ends shaped to provide a spade, fork, ring or hook end. The prongs and spring retainer can also be adapted to provide an improved twist-on connector terminal which terminates multiple conductors to one another.

Still other objects, advantages and distinctions of the invention, as well as other constructions are more apparent at the following description with respect to the appended drawings. To the extent similar structure appears at the drawings, it is identified with similar reference characters or numerals. Various considered modifications and improvements are also described as appropriate. The scope of the invention should not be literally construed nor limited by the disclosed constructions. Rather, the invention should be interpreted to include all those equivalent constructions within the scope of the further amended claims.

DESCRIPTION OF THE PREFERRED EMBODIMENT

Figure 1:
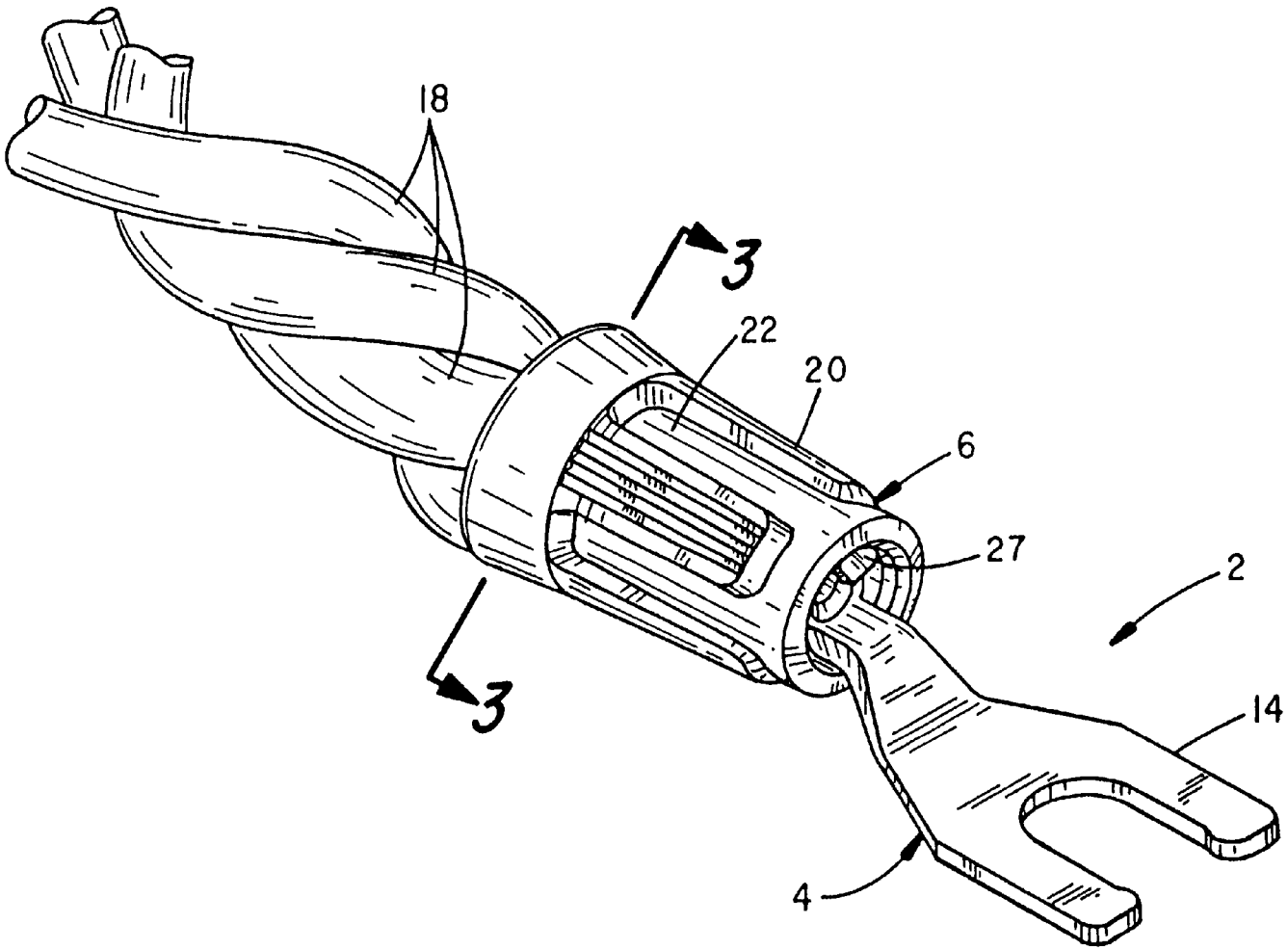
FIG. 1 is a perspective drawing of a connector terminal having a staked terminal end.

With attention to FIGS. 1 through 4, views are shown to an improved connector terminal 2 of the invention. A flat, "U" shaped or forked terminal end 4 is supported to an insulated housing 6 with a number of prongs 8 and a spiral wound spring 10. The prongs 8 and spring 10 provide a compound, permanent attachment of the terminal end 4 to the housing 6. The terminal end 4 is constructed to mount to a typical screw head termination such as commonly found at electrical control circuitry (e.g. a relay, starter, or strip connector terminal). A flat "U" shaped fore end or terminal connector 14 provides a notched recess 16 which mounts beneath a screw.

One or more electrical conductors 18 are secured to the housing 6 with a "twist-on" type of connection. That is, the stripped ends (not shown) of a number of electrical conductors 18 are retained to the spring 10 within the housing 6, upon screwing the housing 6 onto the exposed ends of the conductors 18. The stripped ends may or may not be pre-twisted together. Knurled or ridged protruding surfaces 20 and depressions 22 at the housing 6 facilitate hand twisting the housing 6 to the conductors 18. The alternating protrusions and depressions 20, 22 are also adapted to mate to available drill attachments or sockets to avoid hand mounting operations.

As the housing 6 is screwed onto the exposed ends of the conductors 18, the windings of the spring 10 simultaneously expand to increase the tension of the spring 10 against the prongs 8; the spring 10 having previously been screwed into the housing 6 during manufacture. The terminal end 4 and conductors 18 are thereby positively supported to the housing 6. A compound attachment is thus achieved between the conductors 18, spring 10 and prongs 8 with the housing 6.

As will become more apparent, a wide variety of alternative and many conventional terminal ends can be adapted to include prongs within the scope of the invention. One or more conductors 18 can thereby be coupled to a terminal end that is compatible with a particular wiring application.

Figure 2:
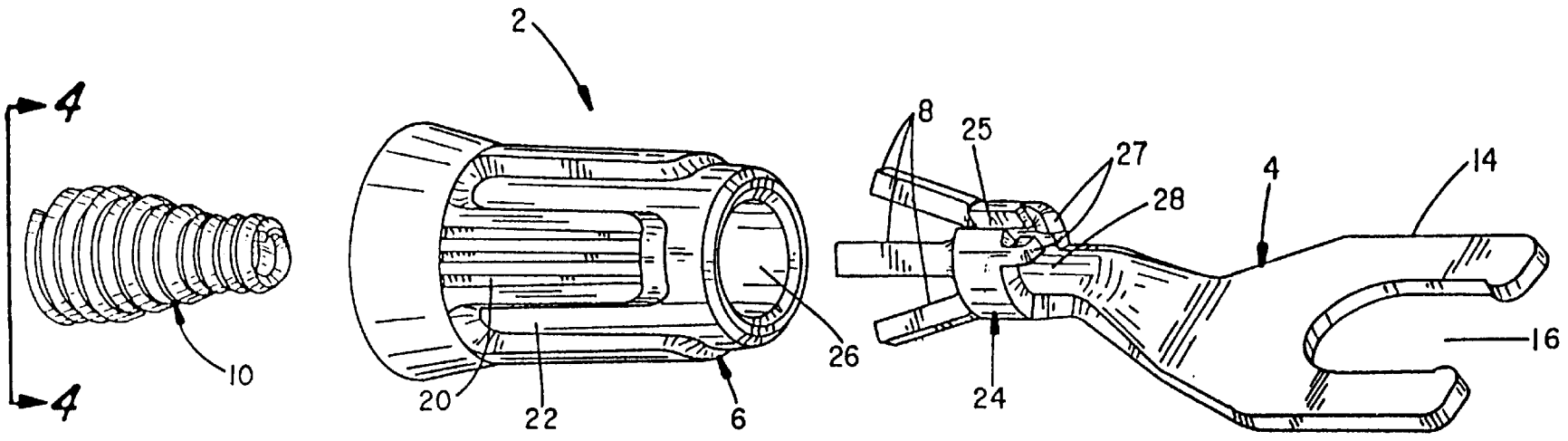
FIG. 2 is a perspective drawing shown in exploded assembly to the connector terminal of FIG. 1.
Figure 3:
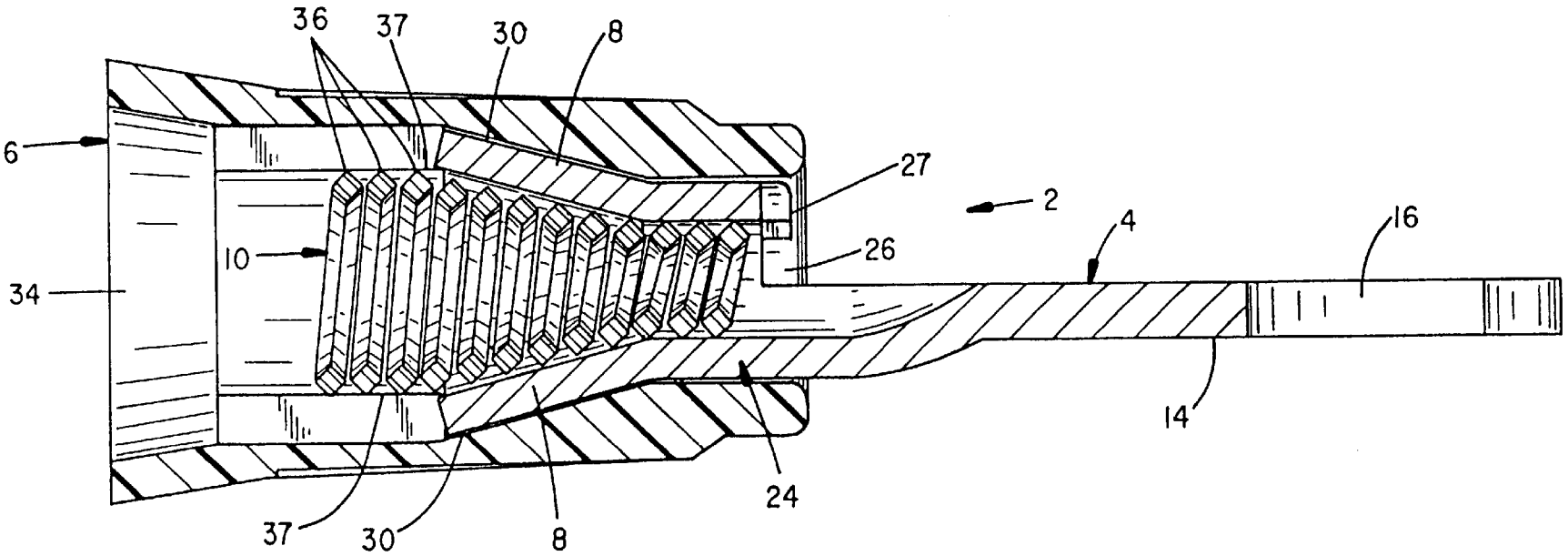
FIG. 3 is a longitudinal section drawing taken along section lines 3—3 through the connector terminal of FIG. 1.
Figure 4:
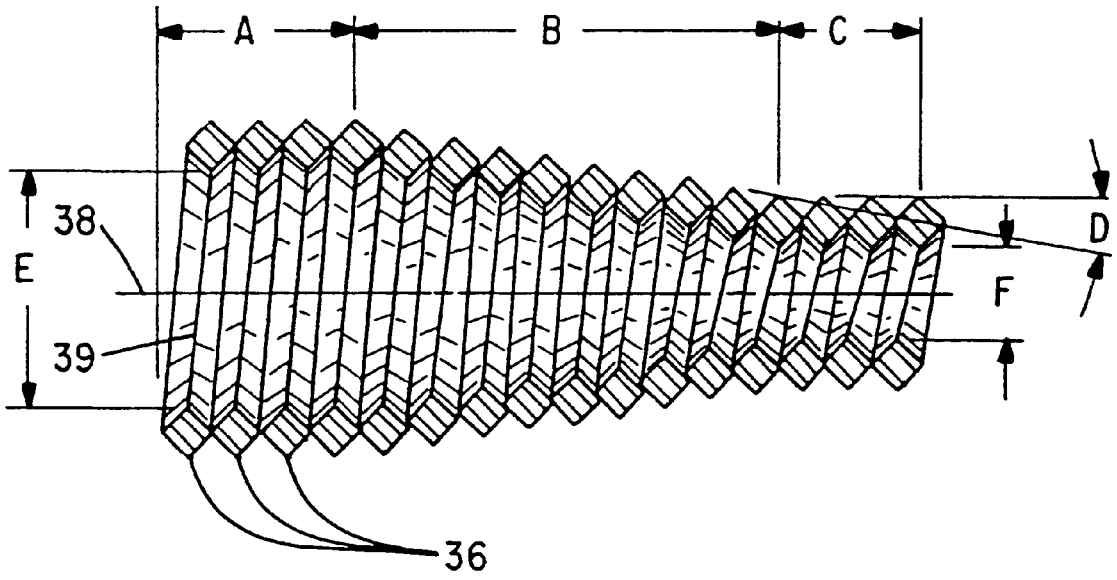
FIG. 4 is a longitudinal section drawing taken along section lines 4—4 through the spring of FIG. 2.

Referring to FIGS. 2, 3 and 4, the prongs 8 are arrayed about a cylindrical collar 24 having a longitudinal slit 25. The prongs 8 normally extend parallel to a longitudinal axis that extends through the center of the collar 24. The initial cylindrical arrangement of the prongs 8 permits the prongs 8 to mount within a bore 26 of the housing 6, prior to a staking operation. A pair of tabs 27 are bent transverse to a bore 28 of the collar 24 and serve to limit the mounting depth of the conductors 18 and/or spring 10 within the housing 6.

The prongs 8 align to four longitudinal grooved surfaces 30 which taper outward as they extend into the housing 6. Although four prongs 8 and grooves 30 are presently provided, more or less can be included, depending upon the type of terminal end 4, and to assure a desired mounting permanency and electrical continuity at the attachment. In lieu of recessed grooves 30, channels may be defined between raised surfaces in the housing 6 or other means may be provided to prevent rotation of the prongs 8 and terminal end 4 as the spring 10 is fitted to the housing 6.

Once the prongs 8 are inserted, the prongs 8 are flared or staked into the grooves 30, during a staking operation, to the depicted conical shape. Once expanded, the prongs 8 contain the terminal end 4 to the housing 6 and prevent subsequent rotation of the terminal end 4 or withdrawal of the terminal end 4 from the housing 6.

The spring 10 is next inserted through an opposite end bore 34 of the housing 6. The spring 10 is rotated and peripheral edges 36 cut into the plastic of the housing 6 at raised surfaces 37 adjacent the grooves 30 and also into the prongs 8, until the spring 10 abuts the tabs 27. The spring 10 thereby secures the prongs 8 in the grooves 30 and the terminal end 4 to the housing 6. When fully seated, the spring 10 is also partially compressed to bias the spring windings to maintain tension with the prongs 8 and assure a permanent mounting of the spring 10 and terminal end 4 to the housing 6.

When multiple conductors are secured to the spring 10, the spring 10 expands further to contain the conductors and simultaneously provide greater contact with the prongs 8 and housing 6. An improved connection is made, which has demonstrated less "hot spots" and reduced values of temperature rise than encountered with conventional twist-on type connectors.

The spring 10 is constructed of a resilient, electrically conductive wire material, such as a phosphor bronze, tensile copper, beryllium, a composite of beryllium or another conductive material or composite which demonstrates high conductivity and resilience. The gauge of the wire is selected as appropriate to the size of the connector terminal 2 and exhibits a rectilinear (e.g. square or other shape having sharp edges on the external and internal surfaces of the spring) cross section. The wire is wound on edge to arrange the corners or edges 36 of the wire to cut or bite into the prongs 8 and housing 6. Sharp edges 36 are also presented along an interior bore 39 which receives the conductors 18.

With attention to FIG. 4, the longitudinal surface of the spring 10 is formed to provide a compound tapered profile in lieu of a conventional single taper. That is, three regions "A", "B", and "C" are each formed with a suitable number of coils of the wire. The regions A and C are wound cylindrical with respect to a longitudinal center axis 38 and exhibit an inside diameter suitable for the number and size of the conductors 18 to be supported at the connector 2. A conical region B joins the end regions A and C and the region B tapers at an angle in the range of 5 to 20 degrees relative to the axis 38. With the proper setting of the spring 10 into the housing 6, the end region C extends into the collar 24 and abuts the tabs 27. The internal diameters E and F of the sections A and C are sized as appropriate for the housing and numbers of conductors to be supported in the bore 39.

Although the spring 10 provides a preferred coupling to the terminal end 4, a molded or machine formed sleeve having sharp, external edges and a similar longitudinal shape might be used. Such a sleeve may or may not be resilient. A non-resilient sleeve can be retained to the housing through a frictional attachment or with a separate fastener or the like to assure the retention of the terminal end 4 and conductors 18 to the housing 6. The spring 10 or sleeve might also include a tang which radiates outward from the longitudinal surface to interlock with a surface or recess at the housing 6 to prevent reverse rotation. That is, with the setting of the spring 10 or sleeve, the tang rotates into engagement with a recess or shouldered projection at the housing 6 to prevent reverse rotation.

Figure 8:
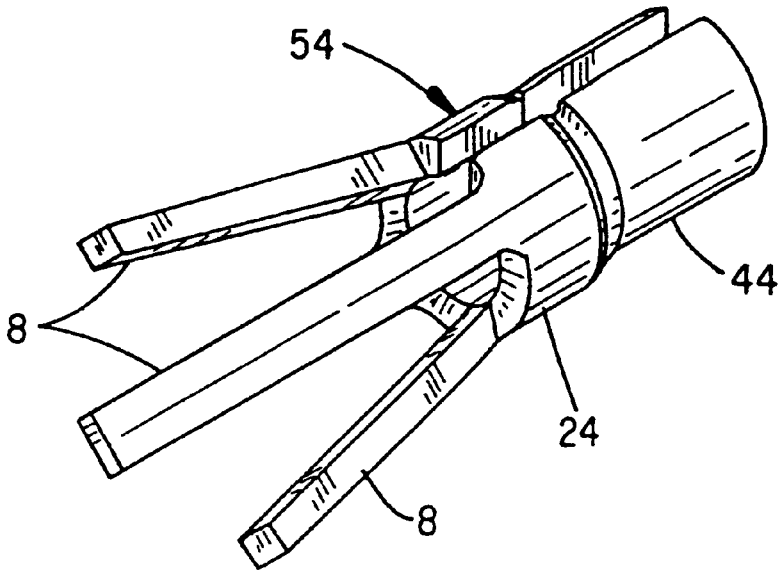
FIG. 8 is a perspective drawing of a crimp type, staked terminal end.
Figure 9:
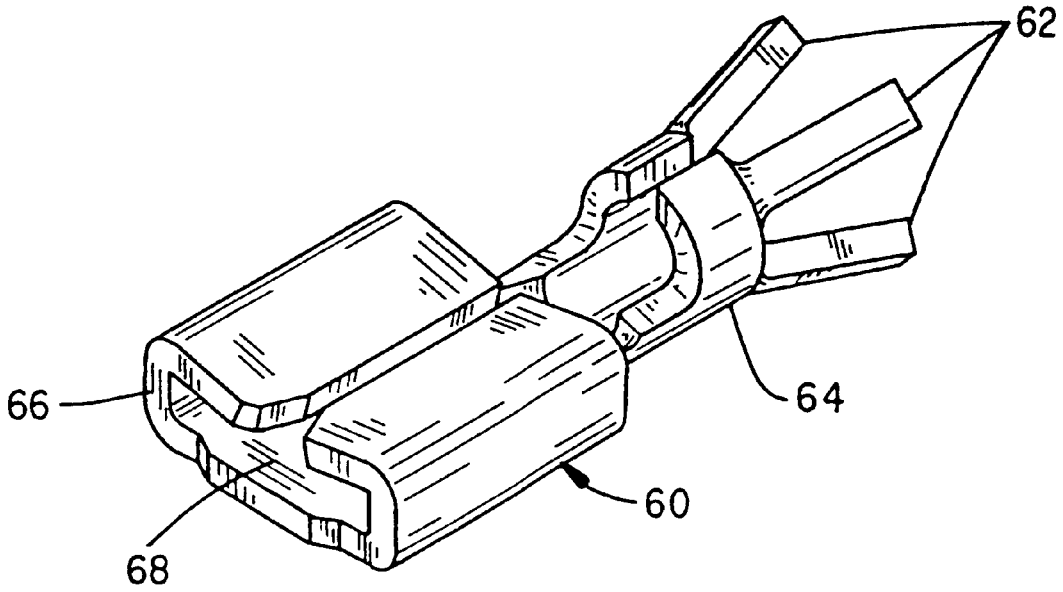
FIG. 9 is a perspective drawing of a female spade type, staked terminal end.

A variety of types of terminal ends can be provided at other connector terminals constructed in the above fashion. The terminal ends are presently constructed of a C26000 brass, although a variety of other conductive materials can be used. Some representative examples are shown at FIGS. 5, 8 and 9.

Figure 5:
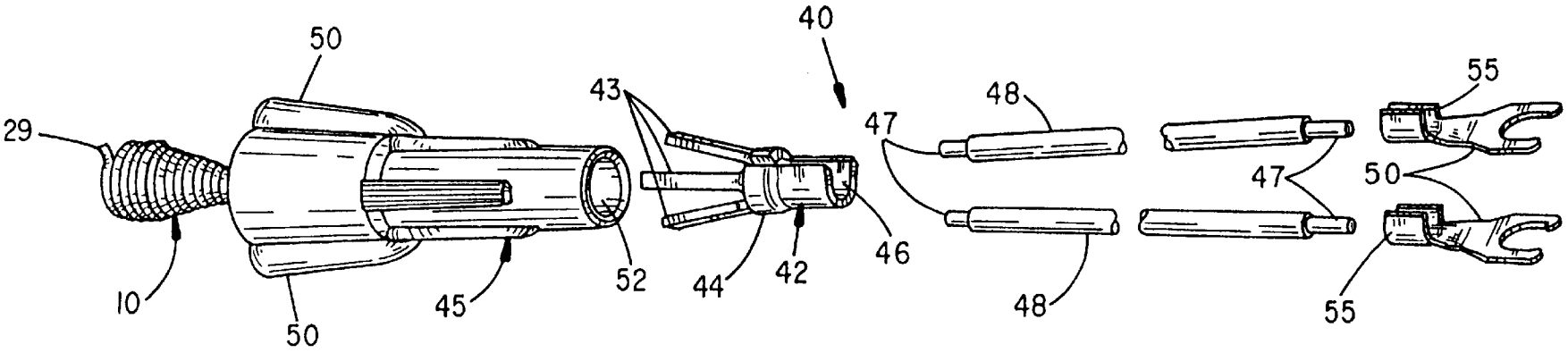
FIG. 5 is a perspective drawing shown in exploded assembly to a multi-conductor "pigtail" connector terminal having a winged housing.

FIG. 5 depicts an exploded assembly drawing of a pigtail connector terminal 40. The connector terminal 40 includes an open barrel crimp type terminal end 42. A closed barrel terminal end 54 is shown in detail at FIG. 8. The terminal end 42 has a number of prongs 43 that extend from a slit cylindrical collar 44. When attached to a housing 45, the prongs 43 are staked to fit grooves 30 within the housing 45 before the spring 10 is positioned to permanently secure the terminal end 42 to the housing 45. A malleable, open barrel collar 46 projects from the collar 44. The stripped ends 47 of the conductors 48 are fitted to the open collar 46 and the collar 46 is compressed with a suitable tool to secure the conductors 48. Alternatively, a closed barrel, crimp type terminal end 54 can be used to secure one or more conductors 48 to the housing 45, reference FIG. 8.

Figure 6:
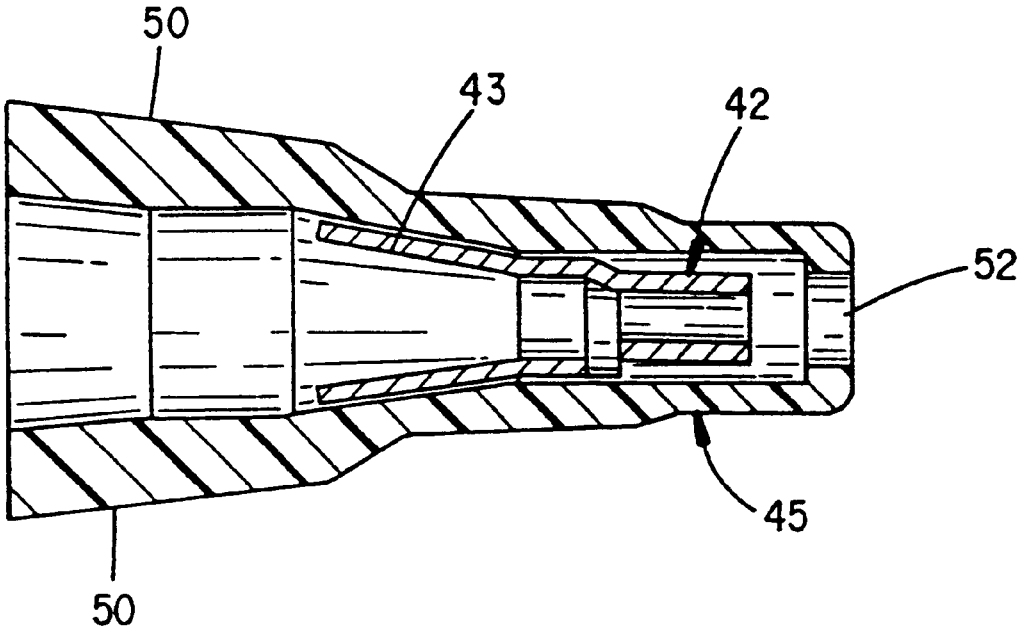
FIG. 6 is a longitudinal section drawing taken through the wings of the housing of FIG. 5.
Figure 7:
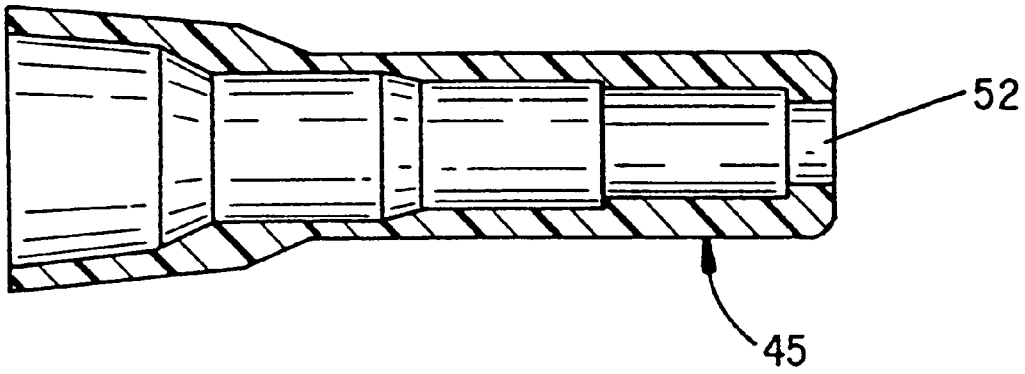
FIG. 7 is a longitudinal section drawing taken between the wings of the housing of FIG. 5.

The housing 45 is similar to the housing 6, except it includes a pair of wings 50 that radiate to facilitate gripping and hand twisting. Like the housing 6, the housing 45 is molded from a Polyflam RPP-1058 material, although a variety of other high dielectric materials may also be used. A forward bore 52 is sized to closely align and fit snug to the crimped collar 46 and conductors 48. FIGS. 6 and 7 depict longitudinal cross section views through the housing 45 taken at 90 degree rotations and with and without the terminal end 42.

Conventional "U" shaped or fork spade connectors 50 having open barrel collars 55 are crimped to the opposite ends of the conductors 48. The stripped ends 47 may also be left plain so that the installer can attach an appropriate terminal end for a particular application.

FIG. 9 depicts another terminal end 60 which also includes a number of prongs 62 that extend from a collar 64. The prongs 62 stake mount to a housing 6, where they are conically flared and separately secured with a spring 10. A female terminal connector 66 extends from the collar 64 and accepts a flat, male spade connector at a cavity 68. Although not shown, it is to be appreciated a wide variety of other terminal ends can be constructed with a multi-pronged collar that is compatible with the spring 10 and a compatible housing to provide any of a variety of male or female connectors that exhibit, flat, rolled, or pin type terminal ends that may exhibit, for example spade, fork, ring, or hook ends, among still other terminal ends.

Figure 10:
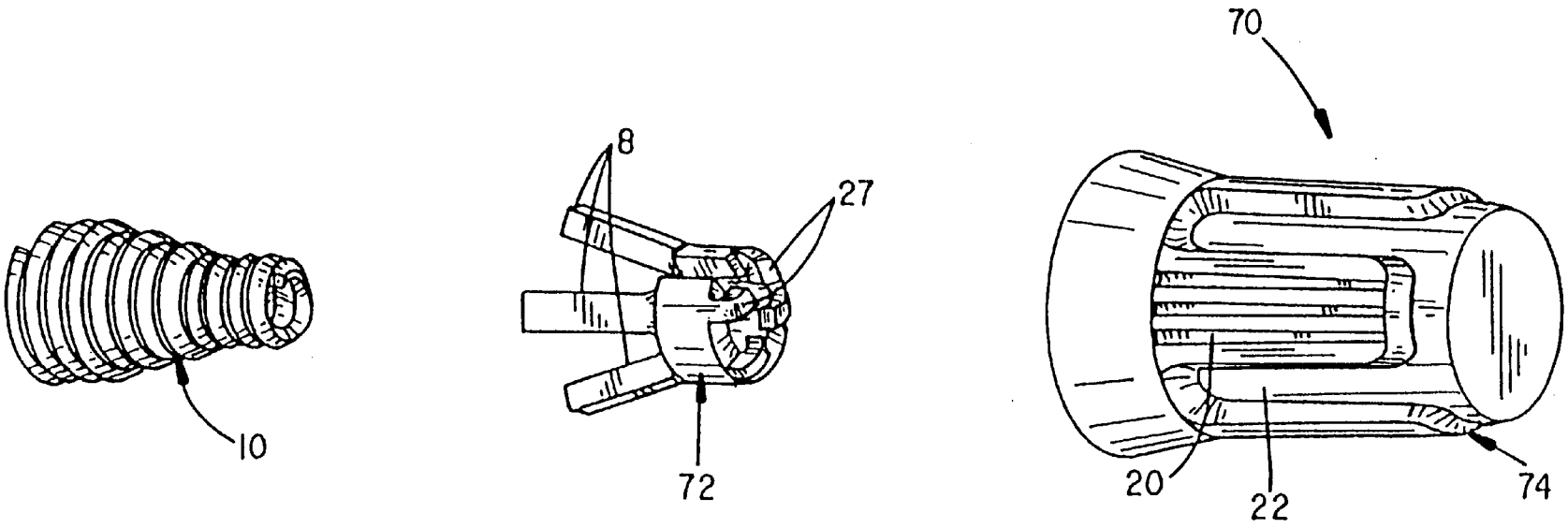
FIG. 10 is a perspective drawing shown in exploded assembly to a twist-on connector including the pronged terminal end and wound spring of the invention.

The pronged terminal end and spring of the invention may also be adapted to use for merely terminating a number of conductors in a conventional twist-on wire connector. In such an instance and with attention to FIG. 10 a twist-on wire connector 70 is shown. The twist-on wire connector 70 includes a collar 72 having a number of prongs 8 and a number of tabs 27, which radiate from an end of the collar 72 and which limit the insertion depth of the spring 10 and contained conductors into the collar 72 and housing 74. The housing 74 has a closed forward end. The spring 10 exhibits a compound surface profile such as described above, although could provide only a single taper.

While the invention has been described with respect to a number of presently considered and preferred connector terminals, it is to be appreciated still other constructions may be suggested to those skilled in the art upon reference hereto. For example and in addition to the foregoing mentioned modifications, the housing may also include molded threads which are compatible with the spring or sleeve. The invention should therefore be construed to include all those equivalent embodiments within the spirit and scope of the following appended claims.

What is claimed is:

1. A connector terminal comprising:

a) a housing having a bore:

b) a terminal end having a plurality of prongs which extend from a terminal connector, wherein the terminal connector is shaped to mount to a mating fitting, and wherein said prongs are contained at interior surfaces in the bore of said housing; and c) retainer means fixedly mounted to the housing within said bore and engaging said prongs for nonremovably securing said terminal end to said housing, and said retainer means having a bore that accepts at least one conductor and includes an internal surface which grips the conductor.

2. A connector terminal as set forth in claim 1 wherein said retainer means comprises a member having first and second cylindrical surfaces which extend from an intermediate conical surface.

3. A connector terminal as set forth in claim 2 wherein said member includes a plurality of spiral edges which project from said member, whereby the spiral edges cut into said prongs, said housing and said conductors.

4. A connector terminal as set forth in claim 1 wherein said retainer means comprises a spiral wound spring having first and second cylindrical surfaces which extend from an intermediate conical surface.

5. A connector terminal as set forth in claim 4 wherein said spring is constructed of a conductive wire having a rectilinear cross section, wherein corner edges are presented along internal and external longitudinal surfaces of the wound spring and wherein said prongs are secured in longitudinal grooves in said housing.

6. A connector terminal as set forth in claim 5 wherein said terminal connector comprises a malleable collar.

7. A connector terminal as set forth in claim 5 wherein said terminal connector comprises a malleable barrel and including at least one conductor crimped to said barrel.

8. A connector terminal as set forth in claim 5 wherein said terminal connector comprises a "U" shaped fork.

9. A connector terminal as set forth in claim 5 wherein said terminal connector comprises a bore adapted to receive a male spade terminal.

10. A connector terminal as set forth in claim 2 wherein said terminal connector comprises a protrusion adapted to mount to a bore of a female spade terminal.

11. A connector terminal comprising:

a) a housing having a bore which includes a plurality of recessed grooves;

b) a terminal end having a plurality of prongs which extend from a terminal connector, the terminal connector being shaped to mount to a mating terminal connector, and wherein said prongs are recessed into said grooves; and c) retainer means mounted within said bore and having a body with a plurality of sharp edges projecting along an external surface of the body and wherein the body has a bore shaped to receive one or more conductors, such that the edges cut into said prongs and said housing for nonremovably securing said terminal end and retainer means to said housing and for securing one or more conductors to said body.

12. A connector terminal as set forth in claim 11 wherein said retainer means exhibits longitudinal resilience and wherein said body has first and second cylindrical surfaces which extend from an intermediate conical surface.

13. A connector terminal as set forth in claim 11 wherein said retainer means comprises a spiral wound spring having first and second cylindrical surfaces which extend from an intermediate conical surface and wherein the windings of said spring exhibit a rectilinear cross section.

14. A connector terminal as set forth in claim 13 wherein said housing includes a plurality of winged projections which facilitate gripping the housing and mounting conductors to said body.

15. A connector terminal comprising:

a) a housing having a bore with a plurality of recessed grooves;

b) a terminal end having a plurality of prongs which extend from a collar and from which collar also extends a terminal connector, wherein the terminal connector is shaped to mount to a mating terminal connector, and wherein said prongs are flared outward and recessed into said grooves; and c) a spiral wound spring means mounted within said bore and having a plurality of sharp edges which project from a body, wherein the body has first and second cylindrical surfaces which extend from an intermediate conical surface, wherein said body has a bore shaped to receive at least one conductor, and wherein the sharp edges cut into said prongs and housing for nonremovably securing said terminal end and spring means to said housing and for removably securing a conductor to said body.

16. A connector terminal as set forth in claim 15 wherein at least one conductor is secured to said terminal connector and projects from said housing.

17. A connector terminal as set forth in claim 15 including means for preventing reverse rotation of said spring means.

18. A connector terminal as set forth in claim 15 wherein said housing includes a plurality of longitudinal protrusions and channels.

19. A connector terminal comprising:

a) a housing having a bore;

b) a terminal end having a plurality of prongs which are contained at interior surfaces in the bore of said housing; and c) retainer means mounted within said bore and having external edges fixed to said housing and engaging said prongs for nonremovably securing said prongs and retainer means to said housing and wherein a bore of said retainer means accepts a plurality of conductors and includes an internal surface which grips the conductors.

20. A connector terminal as set forth in claim 19 wherein said retainer means comprises a spiral wound spring means mounted within said bore and having a plurality of sharp edges which project from a body, wherein the body has first and second cylindrical surfaces which extend from an intermediate conical surface, wherein said body has a bore shaped to receive said plurality of conductors, and wherein the sharp edges cut into said prongs and housing for nonremovably securing said terminal end and spring means to said housing and for removeably securing a conductor to said body.

21. A connector terminal comprising:

a) a housing having a bore terminating at forward and rearward openings;

b) a terminal end comprising a terminal connector and a plurality of prongs extending from the terminal connector, said prongs being initially arranged to permit passage of the prongs through the forward opening and into the housing during installation of the terminal end in the housing, said prongs being deformable after insertion into the housing to prevent removal of the prongs from the forward opening; and c) retainer means mounted within said bore and having external edges fixed to said housing and engaging said prongs for nonremovably securing said prongs and retainer means to said housing and wherein a bore of said retainer means accepts a plurality of conductors and includes an internal surface which grips the conductors.

* * * * *